US007854356B2

(12) United States Patent
Eberhardt

(10) Patent No.: US 7,854,356 B2
(45) Date of Patent: Dec. 21, 2010

(54) CAP FOR AN AEROSOL CONTAINER OR A SPRAY CONTAINER

(75) Inventor: Heiko Eberhardt, Oberursel (DE)

(73) Assignee: Wella AG, Darmstadt (DE)

( * ) Notice: Subject to any disclaimer, the term of this patent is extended or adjusted under 35 U.S.C. 154(b) by 761 days.

(21) Appl. No.: 11/718,904

(22) PCT Filed: Nov. 22, 2005

(86) PCT No.: PCT/EP2005/012483

§ 371 (c)(1),
(2), (4) Date: May 9, 2007

(87) PCT Pub. No.: WO2006/063665

PCT Pub. Date: Jun. 22, 2006

(65) Prior Publication Data

US 2007/0262095 A1 Nov. 15, 2007

(30) Foreign Application Priority Data

Dec. 15, 2004 (DE) ..... 10 2004 060 236

(51) Int. Cl.
*B65D 83/00* (2006.01)

(52) U.S. Cl. ..... 222/402.13; 222/39; 222/153.11; 222/192; 222/321.7; 222/402.24; 239/337; 239/577

(58) Field of Classification Search ..... 222/39, 222/153.11, 192, 321.7, 402.1, 402.13, 402.21, 222/402.24; 239/337, 502, 577
See application file for complete search history.

(56) References Cited

U.S. PATENT DOCUMENTS

| | | | | |
|---|---|---|---|---|
| 3,785,528 | A * | 1/1974 | Mandeltort | 222/148 |
| 5,588,566 | A * | 12/1996 | de Laforcade et al. | 222/402.11 |
| 7,104,427 | B2 * | 9/2006 | Pericard et al. | 222/402.13 |
| 2003/0089734 | A1 | 5/2003 | Eberhardt et al. | |
| 2004/0140328 | A1 * | 7/2004 | Pericard et al. | 222/402.13 |
| 2006/0027595 | A1 | 2/2006 | Eberhardt et al. | |
| 2007/0164056 | A1 * | 7/2007 | Eberhardt et al. | 222/402.13 |
| 2007/0262095 | A1 * | 11/2007 | Eberhardt | 222/402.13 |

FOREIGN PATENT DOCUMENTS

| | | |
|---|---|---|
| WO | 01/96210 | 12/2001 |

* cited by examiner

*Primary Examiner*—Kevin P Shaver
*Assistant Examiner*—Andrew Bainbridge
(74) *Attorney, Agent, or Firm*—Michael J. Striker

(57) ABSTRACT

A spray cap, also known as an actuator overcap for an aerosol container, has an acoustic seal between the actuator button and the overcap. This acoustic seal is formed by a set of matching sealing lips on the actuator button and also on the overcap, such that they are both oriented horizontally. At rest, the sealing lip of the actuator button rests above the sealing lip of the overcap, but during actuation, the sealing lip of the actuator button deforms the sealing lip of the overcap, which both forms an acoustic seal during actuation and creates the force to return the sealing lip of the actuator button back to its original position after actuation is complete.

4 Claims, 4 Drawing Sheets

CAP FOR AN AEROSOL CONTAINER OR A SPRAY CONTAINER

The invention relates to a cap for a container, in particular an aerosol container or a spray container, with a button for manual actuation and for delivering a product present in the container, for example a hair spray, from a product dispensing opening of the cap.

It is known, from WO 01/96210, to seal a cap of this kind in order to obtain a pleasant spraying sound while a product is being dispensed. The articulated button acts against a stem (product dispensing tube) of the container via an angled spray channel in order to deflect the stem by manual actuation of the button and in order therefore to open a valve located in the container, as a result of which a product contained in the container moves out through the stem, the spray channel and a product dispensing opening provided on the cap. A seal in the form of two sealing lips between the button and the cap ensures acoustic sealing of the cap. The sealing lips are oriented vertically and are therefore at all times in function, irrespective of the position of the button. One sealing lip is connected to the button. The other sealing lip is connected to the cap.

The known cap of the type mentioned above has the disadvantage that the seal does not support a simple return pivoting of the pressed button to the non-actuated position.

The object of the invention is to remedy this disadvantage in a cap according to the preamble of claim 1.

The object is achieved by the fact that the sealing lips 8, 9 are oriented horizontally, and that the sealing lip 9 of the button 6 lies on the sealing lip 8 of the cap 7 when the button 6 is not actuated.

The proposed cap has the advantage that an actuated button, after its release, is returned to the uppermost position by the spring force of the deformed sealing lips. The actuation path along which this return movement functions is dependent on the dimensions, in particular the width, of the sealing lips. The restoring force is initially introduced manually into the seals by pressing the button, these seals thus being tensioned. As their tension is released, the button moves back. The function of the sealing lips remains until a defined actuation path is reached. Thereafter, the seal would be released, if this is technically provided for.

The actuating range is safely met if the width of at least one of the two sealing lips increases the farther away the corresponding area of the sealing lip is from the hinge (claim 2). Then, at least one sealing lip is wider where, because of the pivoting movement of the button, the actuation path is increased, and it can thus satisfy the longer actuation path.

If the material thickness of at least one of the two sealing lips decreases the farther away the corresponding area of the sealing lip is from the hinge (claim 3), this means that, with an increasing actuation path, the actuating force does not become too great. A seal of smaller material thickness can be bent and thus tensioned with application of less manual force.

The seal is arranged at the outer edge of the button and likewise on a peripheral upper edge of the cap. In an advantageous embodiment (claim 4), the button is round, for example oval or circular, and the seal runs annularly around the button. In this embodiment, the actuating force is relatively uniform if the seal is formed by a round sealing lip at the edge of the cap and by another round sealing lip at the edge of the button. However, the seal can also be employed in a similar manner with an elongate, narrow button.

The invention is described in more detail below with reference to an illustrative embodiment. In the drawing.

Figure 1:
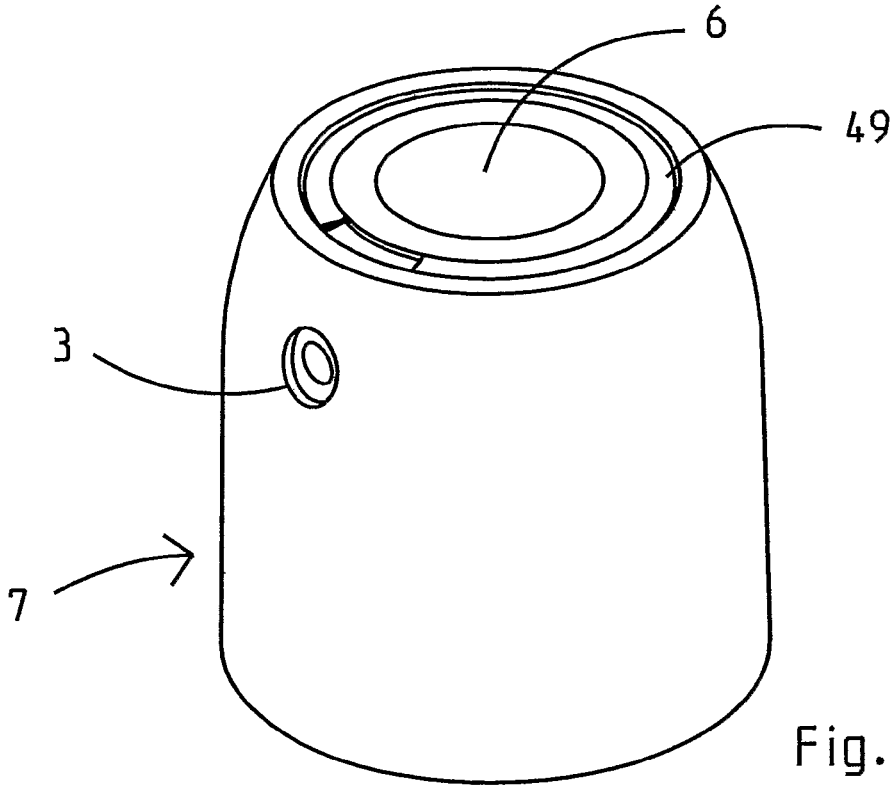
FIG. 1 shows a perspective view of a cap with a round button which is provided with a peripheral seal, for fitting onto an aerosol container.
Figure 2:
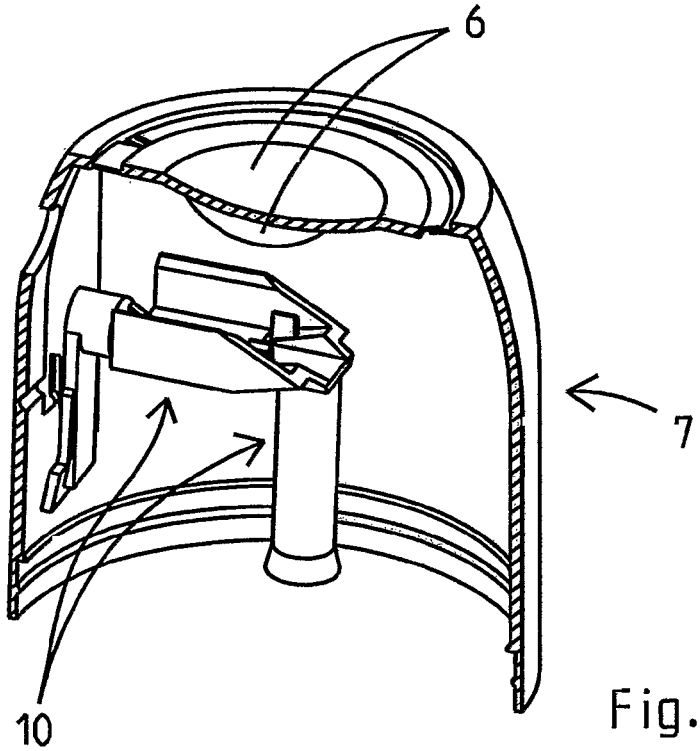
FIG. 2 shows a vertical cross section of the cap with button according to FIG. 1, into which a spray channel is to be inserted.
Figure 3:
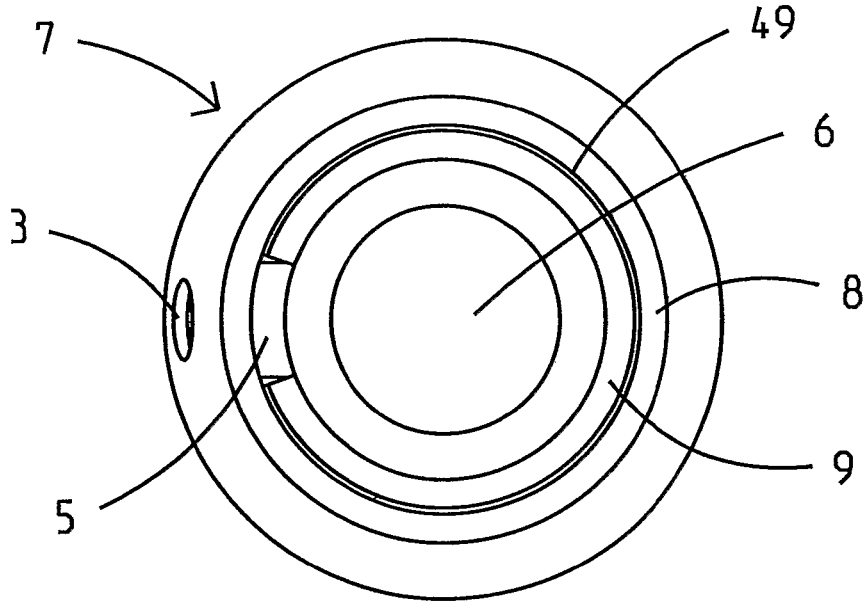
FIG. 3 shows a top view of the article from FIG. 1.

In the case of a spray cap having a cap 7, a button 6 is used to actuate a valve (not shown) of a container 1 which is designed as an aerosol container and contains hair spray. The button 6 is pivotable about a hinge 5 and is intended to act against a stem 11 of the container via an angled spray channel 10 in order to deflect the stem 11 upon manual actuation of the button 6 and in order therefore to open the valve, as a result of which a product contained in the container 1 moves out through the stem 11 and through a product dispensing opening 3 provided on the cap 7, in so doing passing through the spray channel 10 and a nozzle 12. A seal 49 between the button and the cap 7 functions as an acoustic seal 49 of the cap 7 in order to obtain a pleasant spraying sound for the customer. The seal 49 is formed by a sealing lip 8 at the edge of the cap 7 and by a further sealing lip 9 at the edge of the button 6.

The material thickness of the sealing lip 8 of the cap 7 decreases the farther away the corresponding area of the sealing lip 8 is from the hinge 5.

Figure 4:
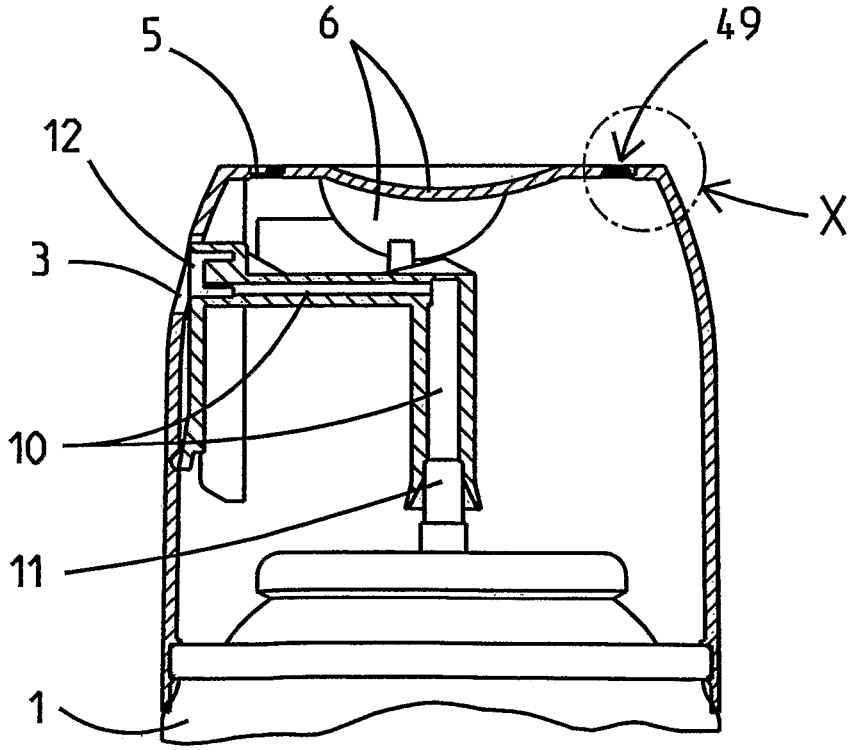
FIG. 4 shows a vertical cross section of the cap from FIG. 1, fitted onto a container, with the button not actuated.
Figure 5:
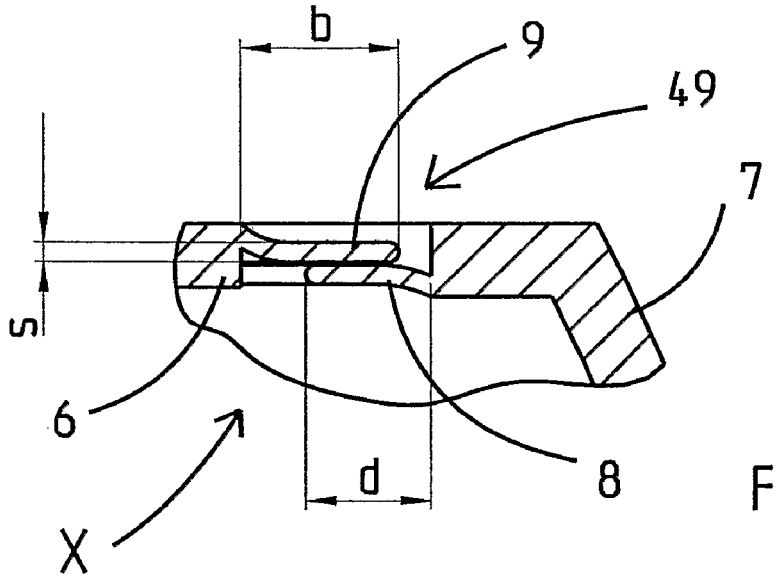
FIG. 5 shows a vertical cross section of a detail X from FIG. 4, illustrating the seal in the form of superposed sealing lips arranged between the cap and the button of the article from FIG. 4.
Figure 6:
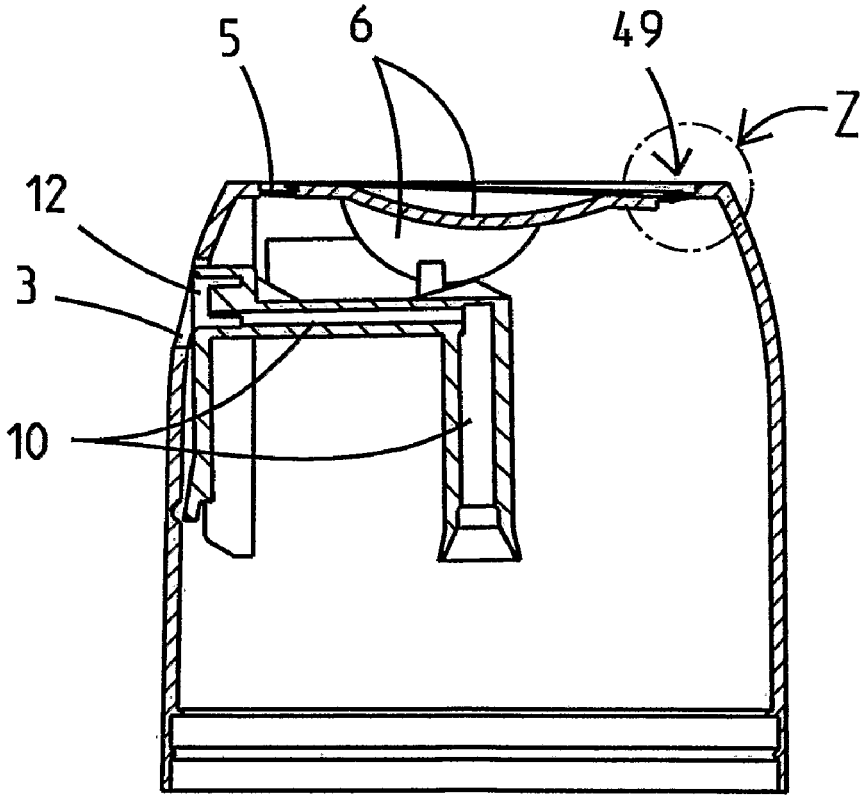
FIG. 6 shows a vertical cross section of the cap from FIG. 4, but with the button slightly pressed.
Figure 7:
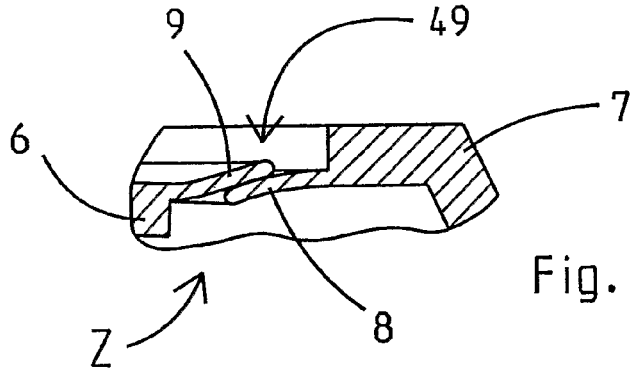
FIG. 7 shows a vertical cross section of a detail Z from FIG. 6.
Figure 8:
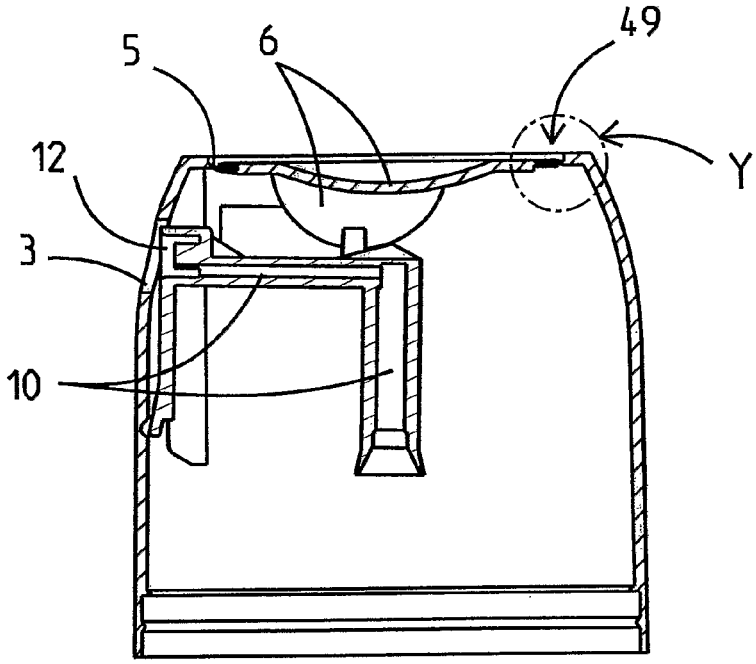
FIG. 8 shows a vertical cross section of the cap from FIG. 6, but after the button has been very strongly pressed.
Figure 9:
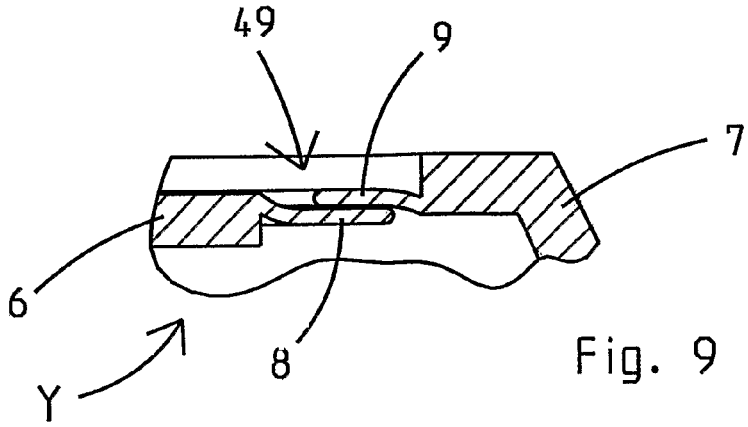
FIG. 9 shows a vertical cross section of a detail Y from FIG. 8.

When the button 6 is pressed, the two sealing lips 8, 9 are first pressed in and thus tensioned (FIG. 7). After the button 6 is released, it easily pivots back into its uppermost position as this tension is canceled (FIG. 4). If the actuation of the button 6 was too strong, the sealing lips 8, 9 would first be separated from one another. Through the restoring force of the valve and the resulting pivoting back of the spray channel 10, the sealing lips 8, 9 would then come to lie on one another in a reverse arrangement (FIG. 9).

b, d width
s material thickness
1 container
2 plug connection
3 product dispensing opening
5 hinge
6 button
7 cap
8, 9 sealing lip
10 spray channel
11 stem
12 nozzle
49 seal

The invention claimed is:

1. A cap (7) with a button (6) for actuating a valve of a container (1), in particular of an aerosol container or spray container, the button (6) being pivotable about a hinge (5) and being intended to act against a stem (11) of the container (1)

via an angled spray channel (10) in order to deflect the stem (11) upon manual actuation of the button (6) and in order therefore to open the valve, as a result of which a product contained in the container (1) can move out through the stem (11) and through a product dispensing opening (3) provided on the cap (7), in so doing passing through the spray channel (10), a sound-limiting seal (49) between the button (6) and the cap (7) is formed by a sealing lip (8) at the edge of the cap (7) and by a further sealing lip (9) at the edge of the button (6), wherein the sealing lips (8, 9) are oriented horizontally, and the sealing lip (9) of the button (6) lies on the sealing lip (8) of the cap (7) when the button (6) is not actuated, wherein applying an actuating force on the button (6) presses the sealing lip (9) of the button (6) against the sealing lip (8) of the cap (7) causing a slight deforming and generating a return spring force, which return spring force acts to return the button (6) to a pre-actuation position when the actuating force is removed.

2. The cap as claimed in claim 1, wherein the width (b, d) of at least one of the two sealing lips (8, 9) increases the farther away the corresponding area of the sealing lip (8, 9) is from the hinge (5).

3. The cap as claimed in claim 1, wherein the material thickness (s) of at least one of the two sealing lips (8, 9) decreases the farther away the corresponding area of the sealing lip (8, 9) is from the hinge (5).

4. The cap as claimed in claim 1, wherein the button (6) is round, preferably circular or oval, and the seal (49) runs annularly around the button (6).

* * * * *